United States Patent [19]

Burge et al.

[11] Patent Number: 4,522,559

[45] Date of Patent: Jun. 11, 1985

[54] COMPRESSOR CASING

[75] Inventors: Joseph C. Burge; Julius Bathori, both of Cincinnati, Ohio

[73] Assignee: General Electric Company, Cincinnati, Ohio

[21] Appl. No.: 632,691

[22] Filed: Jul. 23, 1984

Related U.S. Application Data

[63] Continuation of Ser. No. 350,490, Feb. 19, 1982, abandoned.

[51] Int. Cl.[3] ..... F01D 11/08

[52] U.S. Cl. ..... 415/196; 415/138; 415/177; 415/219 R

[58] Field of Search ..... 415/177, 197, 200, 219 R, 415/108, 128, 138, 196, 174, 134, DIG. 1, 178; 416/214 A

[56] References Cited

U.S. PATENT DOCUMENTS

| | | | |
|---|---|---|---|
| 2,645,413 | 7/1953 | Morley et al. | 230/132 |
| 2,817,124 | 12/1956 | Dybvig | 220/422 |
| 2,848,156 | 12/1956 | Oppenheimer | 230/132 |
| 2,859,935 | 11/1958 | Roesch | 415/177 |
| 3,300,178 | 1/1967 | Rizk et al. | 415/177 |
| 3,304,054 | 2/1967 | Oechslin et al. | 415/177 |
| 3,412,977 | 11/1968 | Moyer et al. | 415/196 |
| 3,854,843 | 12/1974 | Penny | 415/197 |
| 3,966,356 | 6/1976 | Irwin | 415/174 |
| 4,023,919 | 5/1977 | Patterson | 415/174 |
| 4,087,199 | 5/1978 | Hemsworth et al. | 415/197 |
| 4,101,242 | 7/1978 | Coplin et al. | 415/134 |
| 4,127,357 | 11/1978 | Patterson | 415/177 |
| 4,247,249 | 1/1981 | Siemers | 415/200 |
| 4,273,824 | 6/1981 | McComas et al. | 415/200 |
| 4,349,313 | 9/1982 | Munroe et al. | 415/196 |
| 4,363,599 | 12/1982 | Cline | 415/174 |
| 4,398,866 | 8/1983 | Hartel et al. | 415/197 |

FOREIGN PATENT DOCUMENTS

| | | | |
|---|---|---|---|
| 632198 | 12/1961 | Canada | 415/196 |
| 2745130 | 4/1979 | Fed. Rep. of Germany | 415/196 |
| 840952 | 7/1960 | United Kingdom | 220/901 |
| 2076067 | 11/1981 | United Kingdom . | |
| 2016606 | 3/1982 | United Kingdom . | |
| 2038956 | 10/1982 | United Kingdom . | |

*Primary Examiner*—Samuel Scott
*Assistant Examiner*—B. J. Bowman
*Attorney, Agent, or Firm*—Douglas S. Foote; Derek P. Lawrence

[57] ABSTRACT

In a compressor section of a gas turbine engine, a double wall casing is provided wherein a nonstructural inner wall is removably attached to a thin, structural outer casing. The inner wall isolates the thin stator outer casing during transient turbine operations of throttle burst and throttle chop. During throttle burst and chop, the nonstructural inner wall delays rapid heating and cooling of the relatively thin-walled outer casing, and reduces radial misalignment between the stator casing and rotor due to uneven thermal expansion and contraction. The nonstructural inner wall evens-out thermal expansion and contraction of the stator casing with respect to the rotor. To fine tune the actual clearances between stator and rotor and prevent the casing outer wall from overheating, thermal insulation material is used between the nonstructural inner wall and outer casing.

16 Claims, 7 Drawing Figures

COMPRESSOR CASING

This is a continuation of application Ser. No. 350,490, filed Feb. 19, 1982, now abandoned.

BACKGROUND OF THE INVENTION

The present invention relates to a gas turbine engine, and in particular to such an engine having improved compressor performance during periods of transient engine operation.

A current problem existing in turbomachinery, such as, for example, gas turbine compressors, relates to transient thermal response during periods of engine operation known as throttle burst and throttle chop. Throttle burst is the engine speed transition from idle to full power whereas throttle chop is the speed transition by which the engine is brought back to idle. During these periods of transient engine operation, large radial excursions occur in both stator and rotor components. To prevent interference between the compressor stator and rotor during these transient excursions, clearances are provided between the stator and rotor blades. These clearances in typical compressors are undesirably large during both transient and nontransient operation, thus, adversely affecting compressor efficiency and stall margin. More particularly, the outer casing wall of a typical gas turbine compressor stator is relatively thin walled metal, and it responds rapidly to temperature changes during periods of transient engine performance such as throttle burst (advanced or heavy throttle) or throttle chop (reduced throttle).

SUMMARY OF THE INVENTION

Accordingly, it is an object of the present invention to improve gas turbine performance by reducing clearance during transient operation.

It is another object of the present invention to improve gas turbine engine performance by isolating the outer hoop load carrying structure of a compressor casing from excessive heating and cooling effects during transient operation.

It is another object of the present invention to introduce a thermal delay into the outer casing in order to reduce temperature gradients across its wall.

It is a further object of the invention to optimize clearances between stator casing and rotor to improve engine efficiency and stall margins of the compressor.

It is an additional object of this invention to delay the thermal response of the outer wall in order to obtain a better stator-rotor match for optimum clearance.

It is another object of this invention to provide a turbomachine casing for surrounding a rotor wherein an inner wall is attached to and thermally insulated from the casing, for tuning the radial clearances between the rotor and the inner wall to provide a predetermined clearance during operation of the turbomachine.

It is another object of this invention to improve gas turbine performance by cutting the load paths of pressure and temperature from the inner wall to the load carrying outer wall.

In one form of the invention, a turbomachine casing for surrounding a rotor is provided. The casing includes an outer casing wall and an inner casing wall. The inner casing wall is attached to and thermally insulated from the outer wall for tuning a radial clearance between the rotor and the inner wall to provide a predetermined clearance during operation of the turbomachine.

DETAILED DESCRIPTION OF THE INVENTION

Figure 1:
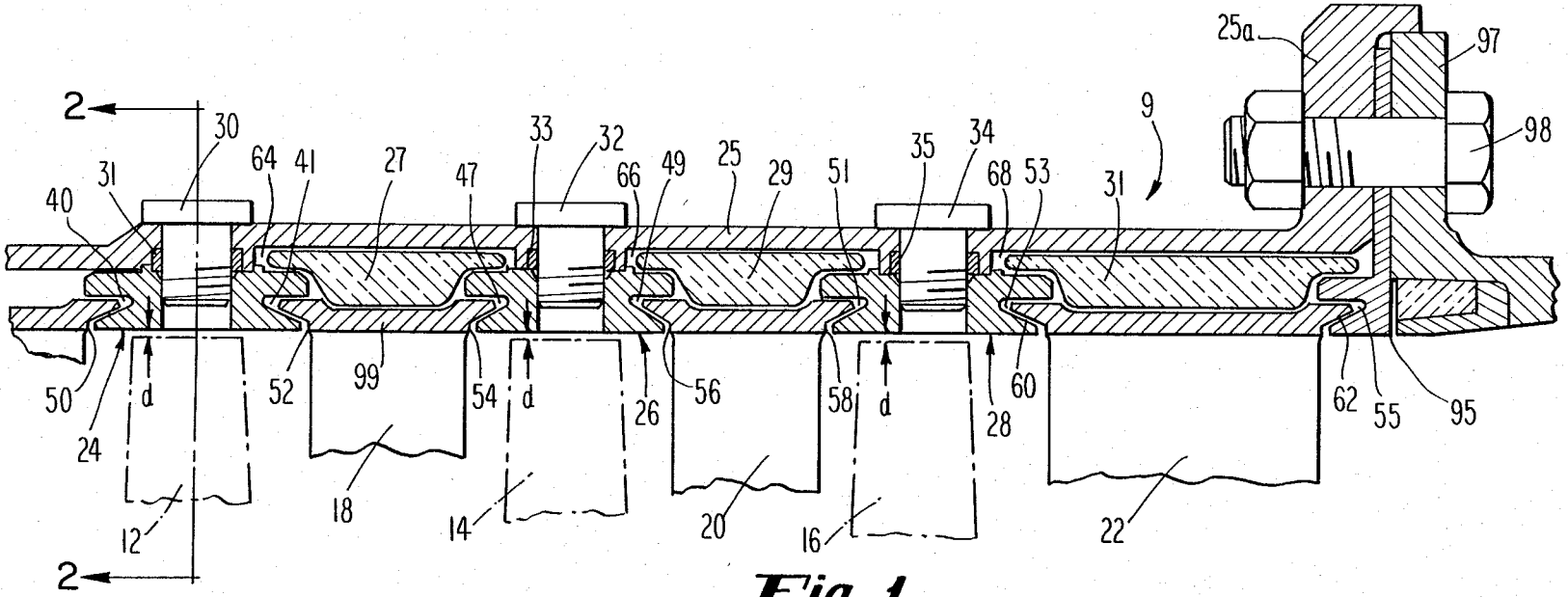
FIG. 1 is a sectional view in the axial direction of part of a compressor embodying one form of the present invention.

Referring now to FIG. 1, there is shown a portion of a compressor 10 of a gas turbine engine in sectional view. The compressor 10 comprises an axially extending, generally cylindrical rotor spool (not shown) disposed radially inward of and spaced from a casing 9 to form an annular gas flow passage (not shown). Casing 9 comprises an outer casing wall 25, an inner casing wall including sectored support rails 70 (shown in FIG. 2) and thermal insulating material 27, 29 and 31. The casing wall 25 comprises an upper and lower half (not shown) which are joined together by means of flanges and bolts (not shown). Extending radially outward from such a rotor spool are a plurality of staged rotor blades 12, 14, 16 which extend across the gas flow passage. Alternating with staged rotor blades 12, 14 and 16 are respective stator vanes 18, 20 and 22 extending radially inward from casing 9. By such arrangement, blades and vanes are in serial flow relation. The spool and the rotor blades 12, 14, 16 are rotatably driven by drive shaft means (not shown) for the purpose of compressing gas flow within the gas passage.

Located directly opposite respective rotor blades 12, 14, 16 are support rail end retainer lugs 24, 26, 28, which are fixedly attached to casing wall 25 by means of respective threaded bolts 30, 32, 34. Tips of the rotor blades 12, 14, 16 are separated from lugs 24, 26, 28 by a distance d. Spacers 31, 33, 35 are interposed between outer casing wall 25 and the respective retainer lugs 24, 26, 28 in order to maintain a proper spatial relationship between outer casing wall 25 and lugs 24, 26, 28.

Figure 4:
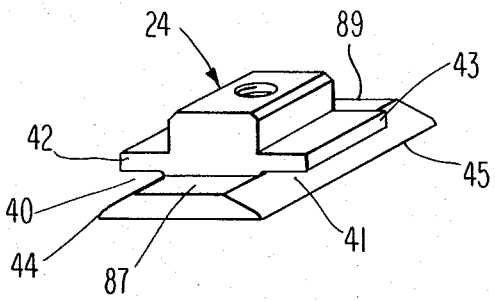
FIG. 4 is an isometric view of a sector support rail retainer lug.

Retainer lugs 24, 26, 28 are shown in greater detail in the isometric view of FIG. 4 and clearly show side slots 40, 41 formed respectively between ledges 42, 43 and sloping members 44, 45. A step 87 is provided on lug 24 whose purpose will be discussed in a later paragraph.

Returning to FIG. 1, stator airfoils or vanes 18, 20, 22 include respective mounting tangs, 52, 54, 56, 58, 60, 62. Mounting tangs, 52, 54, 56, 58, 60, 62 are respectively provided for mating engagement with said slots, 41, 47, 49, 51, 53, 55 whereby stator vanes 18, 20, 22 are attached to casing wall 25. Immediately above the stator mounting platforms' 99, tangs 52, 54, 56, 58, 60, 62 and the inner surface of casing wall 25 are respective spaces 64, 66, 68, wherein insulation 27, 29, 31 may be inserted.

It is noted that vane 22, which is an outlet guide vane is of larger size than vanes 18, 20. The outlet guide vane is located in the casing's aft end and is the last vane in the compressor section. Slot 55 for mating with tang 62 is provided in a ring 95 sandwiched between the casing flange 25*a* and a frame flange 97. The ring 95 is maintained in place with flange member 25*a*, 97 by means of bolt and nut combination 98.

The compressor 10 consists of one or more stages wherein each stage is comprised of a rotating multi-bladed rotor and a nonrotating multi-vane stator. An axial compressor is normally of a multi-stage construction. Within each stage, air flow is accelerated and decelerated with resulting pressure rise. To maintain the axial velocity of the air as pressure increases, the cross-sectional flow area is gradually decreased with each compressor stage from the low to high pressure end. The net effect across the compressor is a substantial increase not only in air pressure, but also in temperature.

Figure 2:
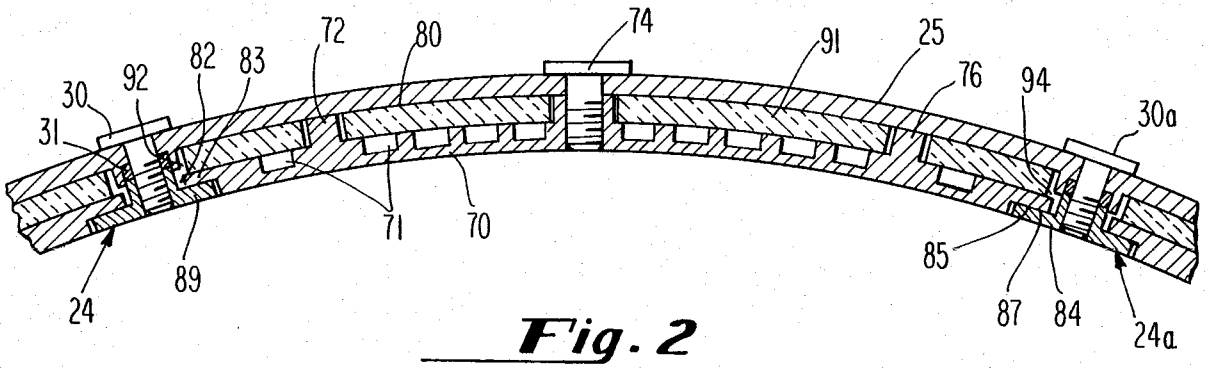
FIG. 2 is a sectional view taken along lines 2—2 in FIG. 1.
Figure 3:
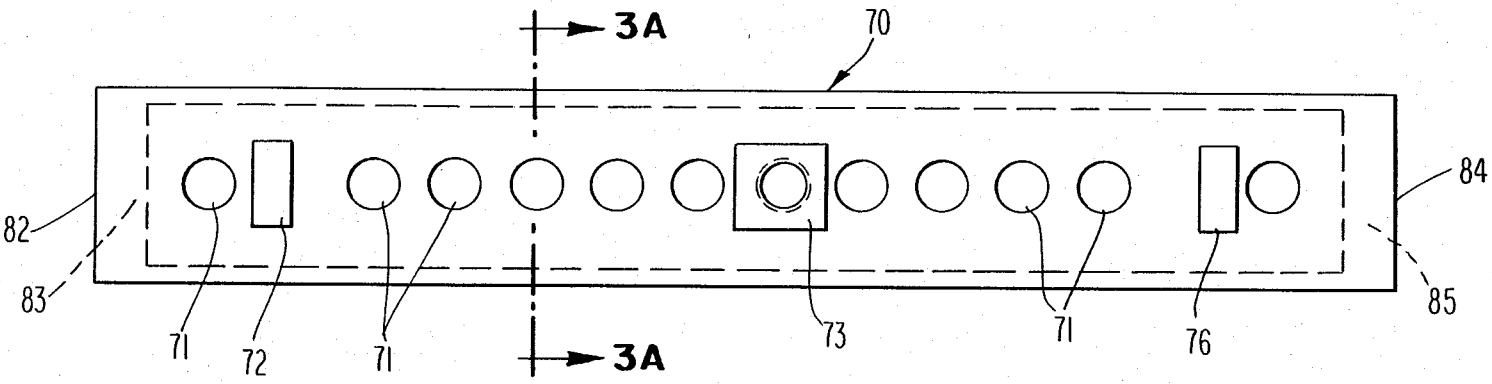
FIG. 3 is a plan view of a sector support rail 70 shown in FIG. 2.
Figure 3A:
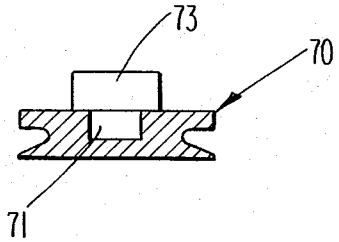
FIG. 3A is a sectional view of the support rail of FIG. 3 taken on lines 3A—3A.

Reference is made to FIG. 2 which is a radial, or circumferential, cross-sectional view of exemplary sectored support rail 70 and associated hardware as as utilized in this invention. The plane of FIG. 2 is perpendicular to the plane of FIG. 1 and is obtained by passing a cutting plane, e.g., plane 2—2 through the center of bolt 30, perpendicular to the plane of FIG. 1. The rotor and stator blades shown in FIG. 1 have been omitted from FIG. 2 for clarity. Support sectored support rail 70 (see FIGS. 3, 3A) is shown attached to casing wall 25 via a tapped-through hole for retention bolt 74 in retainer lug 73. Support rail 70, which is made of Inconel 718, a well known nickel-based alloy, has a high tolerance to heat and also a high coefficient of thermal expansion relative to that of the material of the outer structural wall. Additional retention lugs 72, 76 are provided along rail 70 so that they interface with an inner radial surface 80 of casing wall 25. Ends 82, 84 of the sectored rail 70 are fabricated with a respective step 83, 85 which is adapted to mate with the respective steps 87, 89 formed on the support rail end retainer lugs 24, 24*a*. It should be noted that circumferential clearances 92, 94 are provided for ends 82, 84 with respect to support rail lugs 24, 24*a* to allow for circumferential expansion of the sector support rail 70. In other words, during throttle burst when engine temperature increases the sectored support rail 70 will move circumferentially by increasing its length which will be absorbed into clearances 92. 94. Furthermore, sectored support rail 70 will be restrained radially in view of the positioning of retention lugs 72, 76 against outer casing wall 25. In effect, the thermal time constant of casing wall 25 has been delayed after the application of heat in view of the delaying functions provided by the sectored support rail 70.

Eleven lightening pockets 71 are provided along the length of sectored support rail 70 in order to reduce its weight to a minimum. Additional space 91 is provided above the lightening pockets 71 to allow for insulation e.g., blanket type, to be placed between the outer casing wall 25 and sectored support rail 70. This insulation is used to thermally protect the outer casing walls as well as to thermally insulate the support rails from the outer casing walls. It should be appreciated that only one sectored support rail 70 has been discussed, whereas in actual practice sufficient rails will be utilized to circumferentially surround rotor blades 12, 14 and 16.

Preferably, the insulation 91 comprises a glass-wool type insulator enclosed in a stainless steel sheet holder for handling and installation. For example, a glass-wool type insulator commercially available under the designation KAO-WOOL from Babcock & Wilcox, Co. can be utilized. If desired, the insulator material may be in powder form such as the one commercially available as MIN-K from Johns-Manville Company. Also, in place of the shown blanket type insulation, a flange sprayed thermal barrier coating such as nickel, chromium, aluminum/bentonite (NiCrAL-Bentonite) from METCO, Inc., can be used. A ceramic such as Yttria-Zirconia may also be used to thermally insulate the outer casing wall.

In accordance with one form of the present invention, outer casing wall 25 as shown in FIG. 2 is a structural wall i.e., hoop load carrying, whereas sectored support rails 70 of the inner casing wall, which is attached to the outer casing wall, forms part of the inner nonstructural wall i.e. non-hoop load carrying. It will be appreciated that the inner nonstructural wall to which this invention pertains extends circumferentially and lengthwise along the axial direction and, as shown in cross section in FIGS. 1 and 2 comprises, in part, lugs 24 and 26, mounting tangs 52 and 54, vane platform 99 of vane 18 between tangs 52 and 54 and sectored support rail 70.

In view of the relative thinness of the outer casing wall 25, use of single wall casings have responded rapidly to changes in air temperature especially during periods of engine transience, for example, application of throttle burst or throttle chop. During throttle burst, the casing wall 25 thermally responds to an increase in air temperature by radial expansion faster than does the thermal response of the rotor. Consequently, the radial clearance "d" between the stator casing and the rotor blade tips increases substantially whereby the turbine engine becomes inefficient. This phenomenon can be seen by referring to a dotted curve in FIG. 5, which is a graph of a typical compressor stage and indicates average transient clearance between a rotor tip blade and the stator casing over a period of engine performance. A hump in the dotted curve illustrates increased rotor clearances as a result of throttle burst. A dip in the dotted curve just prior to the hump formation is due to growth of the rotor dimensions with respect to the stator casing because of stress, which is related to an elasticity characteristic of the metal.

During throttle chop, the casing wall 25 will conventionally try to thermally shrink faster than that of the rotor. Also, there is an initial rapid decrease of the rotor dimensions at this time because of the elasticity factor. These considerations will cause the clearance to increase after a steady state take-off condition has been reached, and will cause a dip in the dotted curve around a point where chop is initiated.

Figure 5:
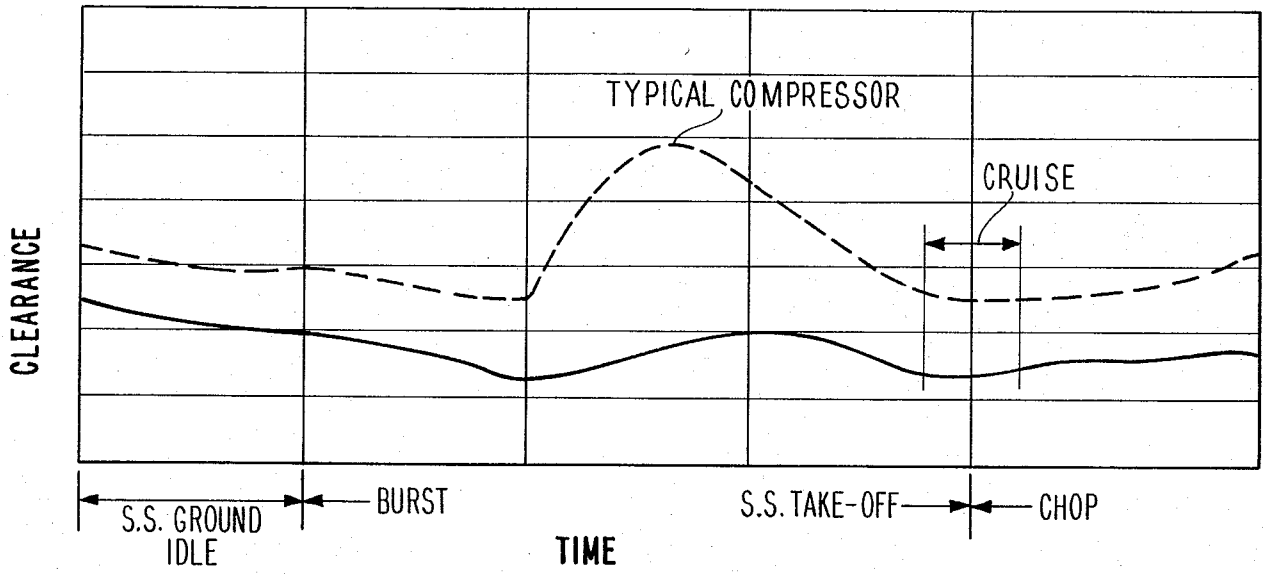
FIG. 5 is a graph comparing transient clearances in a prior art compressor stage with transient clearance achieved in the same stage by one form of the present invention.

It can be appreciated from the dotted line (prior art) curve of FIG. 5 that there is great clearance variation with respect to steady-state ground idle in the compressor during engine operation, which is not conducive to optimum engine performance. The solid curve represents compressor clearance variations in accordance with one form of the invention discussed herein. It can be readily appreciated that extreme clearance variations during transient operation have been substantially eliminated resulting in improved engine operation. In addition, the presence of the insulation material desirably reduces clearances during steady state operation, e.g., cruise and ground idle.

Figure 6:
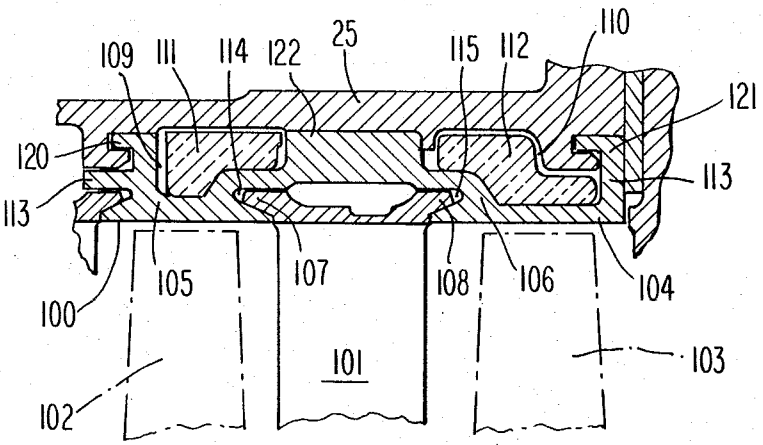
FIG. 6 is another embodiment of the present invention, taken as in FIG. 1.

Referring now to FIG. 6, another embodiment of the present invention is shown wherein a different arrangement is provided near the aft end of a compressor in the vicinity of stator vane 101, and rotor blades 102, 103. As may be noted by comparing FIGS. 1 and 6, the aft end of the compressor of FIG. 6 has been modified from that shown in FIG. 1 to accommodate this embodiment. The variation near the aft end of the compressor uses an integral (lug-less) inner casing wall 113 having two sectored support rails 105, 106 including two rub liners 100, 104. Located within support rails 105, 106 are two oppositely positioned slots 114, 115 which are adapted to mate with respective tangs 107, 108 for holding the stator blade 101 in position. The integral inner casing wall 113 incorporates two pockets 109, 110 for locating insulation 111, 112 therein. In the manner previously described, the integral inner casing wall 113 is a nonstructural member which is attached to a structural outer casing wall 25, i.e., hoop load carrying. As shown in FIG. 5, integral inner casing wall 113 is dovetailed into outer wall 25 at 120, 121 and may be removably attached to wall 25 as by a bolt (not shown) through wall 25 into thick region 122 in the manner previously described. The integral inner casing wall 113 in conjunction with the insulation 111, 112 is designed to thermally insulate the outer casing wall 25 during transient operation to thereby minimize radial misalignment between the outer casing and the rotor.

The nonstructural inner wall arrangement of this invention increases the thermal time constant of the outer casing wall 25 thereby minimizing radial misalignment. The thermal time constant is that time that it takes the casing wall 25 to reach 66% of applied heat temperature after application thereof. In the prior art use of thin casing walls, the time constant was small, that is, the casing would heat up to 66% of the applied heat quite rapidly. This rapid heating would cause concomitant radial aberrations such as radial misalignment due to the above discussed thermal expansion or shrinkage of the casing.

In the present invention, during throttle bursts and chops, the circumferential end gaps in the sectored casing inner wall close and open freely. This cuts the load paths of both pressure and temperature from the inner wall to the casing outer wall. Cutting these load paths improves the stress and deflection characteristics of the outer casing wall while allowing the tuning of the radial clearances between the rotor blade tips and the inner casing wall.

Although the present invention has been described in connection with a compressor, it is applicable to other forms of turbomachinery, such as, for example, high and low pressure turbines. Also, it is to be appreciated that various forms of insulation may be employed to provide the desired engine operating characteristics. For example, thermal barrier coatings and other types of insulation may be employed.

It will be understood that the foregoing suggested apparatus as exemplified by the Figures, is intended to be illustrative of a preferred embodiment of the subject invention and that many options will readily occur to those skilled in the art without departure from the spirit or the scope of the principles of the subject invention.

What I claim is:

1. A turbomachine casing surrounding a rotor comprising:

an outer casing wall;

a sectored inner casing wall;

means for insulating said inner wall from said casing; and means for removably attaching said inner casing wall to said outer casing wall, such that during transient operation of said turbomachine expansion of said inner casing wall initially occurs in the circumferential direction, after which said outer casing wall and inner casing wall expand radially in a substantially uniform manner, and wherein said rotor in said turbomachine radially expands substantially in concert with said casing.

2. In a turbomachine including an arrangement of a first rotor blade, a fixed vane attached to a vane platform, and a second rotor blade in serial flow relationship, a casing circumferential surrounding such arrangement, comprising:

an outer casing wall;

an inner casing wall including a first sectored support rail radially disposed relative to said first blade, a second sectored support rail radially disposed relative to said second blade, and attachment means for removably attaching said rails to said outer casing wall and allowing circumferential expansion of sectors of each rail; wherein said vane platform is supported by and between said first and second sectored support rails; and thermal insulating material in the space formed between said outer casing wall and said inner casing wall and vane platform.

3. A casing in accordance with claim 2 wherein said thermal insulating material comprises a blanket-type insulation.

4. A casing in accordance with claim 3 wherein said blanket-type insulating material comprises glass wool.

5. A casing in accordance with claim 2 wherein said thermal insulating material comprises a powder.

6. A casing in accordance with claim 2 wherein said thermal insulating material comprises a thermal barrier coating deposited on the surfaces enclosing said space formed between said outer casing wall and said inner casing wall and vane platform.

7. A casing in accordance with claim 2 wherein said thermal insulating material comprises a Yttria-Zirconia ceramic.

8. A casing in accordance with claim 2 wherein said vane platform includes oppositely positioned tangs and said first and second sectored support rails have oppositely positioned slots therein adapted to matingly engage said tangs to support said vane and vane platform in spaced relation to said outer casing wall.

9. A casing in accordance with claim 2 wherein said attachment means includes a plurality of retainer lugs, each with circumferentially facing steps;

wherein said sectored support rails each have circumferentially facing steps adapted to mate with the respective one of said circumferentially facing steps of said retainer lugs; and wherein a circumferential clearance between said sectors and said lugs is provided so as to allow circumferential expansion of said sectors.

10. In a turbomachine including an arrangement of a first rotor blade, a fixed vane attached to a vane platform, and a second rotor blade in serial flow relationship, a casing circumferentially surrounding said arrangement, comprising:

an outer casing wall;

an integral inner casing wall including first and second sectored support rails radially disposed relative to said first and second blades, wherein said inner casing wall includes at least one pocket facing said outer casing wall and engagement means which is adapted to hold said vane platform;

attachment means for removably attaching said rails to said outer casing wall and allowing circumferential expansion of said rails; and thermal insulating material in said pocket.

11. A casing in accordance with claim 10 wherein said vane platform includes oppositely positioned tangs and wherein said engagement means includes oppositely positioned slots adapted to matingly engage said tangs.

12. A casing in accordance with claim 10 wherein said thermal insulating material comprises a blanket-type insulation.

13. A casing in accordance with claim 12 wherein said blanket-type insulating material comprises glass wool.

14. A casing in accordance with claim 10 wherein said thermal insulating material comprises a powder.

15. A casing in accordance with claim 10 wherein said thermal insulating material comprises a thermal barrier coating deposited on the surfaces enclosing said pocket.

16. A casing in accordance with claim 10 wherein said thermal insulating material comprises a Yttria-Zirconia ceramic.

* * * * *